US011213066B2

(12) United States Patent
Motodamari et al.

(10) Patent No.: US 11,213,066 B2
(45) Date of Patent: Jan. 4, 2022

(54) CIGARETTE

(71) Applicant: JAPAN TOBACCO INC., Tokyo (JP)

(72) Inventors: Tetsuya Motodamari, Tokyo (JP); Susumu Yokogawa, Tokyo (JP)

(73) Assignee: JAPAN TOBACCO INC., Tokyo (JP)

( * ) Notice: Subject to any disclaimer, the term of this patent is extended or adjusted under 35 U.S.C. 154(b) by 687 days.

(21) Appl. No.: 14/041,889

(22) Filed: Sep. 30, 2013

(65) Prior Publication Data

US 2014/0026908 A1 Jan. 30, 2014

Related U.S. Application Data

(63) Continuation of application No. PCT/JP2011/058343, filed on Mar. 31, 2011.

(51) Int. Cl.
*A24D 3/04* (2006.01)
*A24D 3/06* (2006.01)

(52) U.S. Cl.
CPC ..... *A24D 3/043* (2013.01); *A24D 3/061* (2013.01)

(58) Field of Classification Search
CPC ..... A24D 3/061; A24D 3/043
See application file for complete search history.

(56) References Cited

U.S. PATENT DOCUMENTS 4,649,944 A 3/1987 Houck, Jr. et al.
5,050,622 A * 9/1991 Raker ..... A24D 1/02 131/365
6,206,007 B1 3/2001 Yoshida et al.
2002/0166563 A1* 11/2002 Jupe ..... A24F 1/00 131/331
2004/0074507 A1 4/2004 MacAdam et al.
2004/0261807 A1 12/2004 Dube et al.
2006/0174901 A1* 8/2006 Karles ..... A24D 3/163 131/337

(Continued)

FOREIGN PATENT DOCUMENTS

EP 0105682 * 9/1983 ..... A24D 3/04
EP 0 101 173 A1 2/1984
EP 1 889 550 A1 2/2008

(Continued)

OTHER PUBLICATIONS

Risks Associated with Smoking Cigarettes with Low Machine-Measured Yields of Tar and Nicotine. Tobacco Control Monograph No. 13. NIH Pub. No. 02-5047, Oct. 2001. [retrieved on Nov. 20, 2020], retrieved from: https://cancercontrol.cancer.gov/sites/default/files/2020-08/m13_complete.pdf (Year: 2001).*

(Continued)

*Primary Examiner* — Michael J Felton
*Assistant Examiner* — Yana B Krinker
(74) *Attorney, Agent, or Firm* — Birch, Stewart, Kolasch & Birch, LLP

(57) ABSTRACT

A cigarette includes a tobacco rod, and a filter comprising a first filter plug on a tobacco rod side connected to an end of the tobacco rod, a second filter plug on a cigarette end side, and a flavor capsule arranged between the first and second filter plugs or in the second filter plug. The first filter plug has a ventilation hole, and ventilation resistance of the second filter plug is lower than that of the first filter plug.

7 Claims, 4 Drawing Sheets

(56) References Cited

U.S. PATENT DOCUMENTS

| | | | | |
|---|---|---|---|---|
| 2008/0029114 | A1 | 2/2008 | Seitert et al. | |
| 2010/0294290 | A1* | 11/2010 | Zhang | A24B 15/283 131/328 |

FOREIGN PATENT DOCUMENTS

| | | | |
|---|---|---|---|
| JP | 59-501892 | A | 11/1984 |
| JP | 10-4944 | A | 1/1998 |
| JP | 11-69965 | A | 3/1999 |
| JP | 2003-304856 | A | 10/2003 |
| JP | 2007-520204 | A | 7/2007 |
| JP | 2009-504175 | A | 2/2009 |
| JP | 2011-41574 | A | 3/2011 |
| WO | WO 02/069745 | A1 | 9/2002 |
| WO | WO 03/009711 | A1 | 2/2003 |
| WO | WO 2005/032287 | A2 | 4/2005 |
| WO | WO 2006/082161 | A1 | 8/2006 |
| WO | WO 2006/117697 | A1 | 11/2006 |
| WO | WO 2007/060543 | A2 | 5/2007 |
| WO | WO 2010/133334 | A1 | 11/2010 |

OTHER PUBLICATIONS

Communication issued in corresponding EP Application No. 11862441.0 dated Jul. 21, 2016.
Search Report issued in corresponding EP Application No. 11862441.0 dated Aug. 17, 2016.

* cited by examiner

CIGARETTE

CROSS-REFERENCE TO RELATED APPLICATIONS

This is a Continuation application of PCT Application No. PCT/JP2011/058343, filed Mar. 31, 2011, which was published under PCT Article 21(2) in Japanese, the entire contents of which are incorporated herein by reference.

BACKGROUND OF THE INVENTION

1. Field of the Invention

The present invention relates to a cigarette containing a flavor capsule in a filter.

2. Description of Related Arts

Conventionally, a flavor capsule is incorporated in a cigarette filter and the flavor capsule is crushed in order to enjoy the flavor of the content liquid in smoking or in order to mask odor of a cigarette butt after the cigarette is extinguished (Jpn. Pat. Appln. KOKAI Publication No. 2003-304856, Jpn. PCT National Publication No. 2007-520204, and Jpn. PCT National Publication No. 2009-504175).

Jpn. Pat. Appln. KOKAI Publication No. 2003-304856 discloses a cigarette filter having a filter material and a capsule containing a deodorant capable of reducing smoke odor. Jpn. PCT National Publication No. 2007-520204, and Jpn. PCT National Publication No. 2009-504175 disclose a cigarette comprising a tobacco rod, and a filter element having a crushable capsule arranged in a cavity between two filter materials. However, in the conventional cigarettes, efficient delivery of a flavor is not taken into consideration.

BRIEF SUMMARY OF THE INVENTION

An object of the present invention is to provide a cigarette capable of improving permeability of a flavor in tobacco smoke.

According to the present invention there is provided a cigarette including: a tobacco rod; and a filter comprising a first filter plug on a tobacco rod side connected to an end of the tobacco rod, a second filter plug on a cigarette end side, and a flavor capsule arranged between the first and second filter plugs or in the second filter plug, wherein the first filter plug has a ventilation hole, and ventilation resistance of the second filter plug is lower than that of the first filter plug.

DETAILED DESCRIPTION OF THE INVENTION

Hereinafter, embodiments of the present invention will be described with reference to the drawings.

Figure 1:
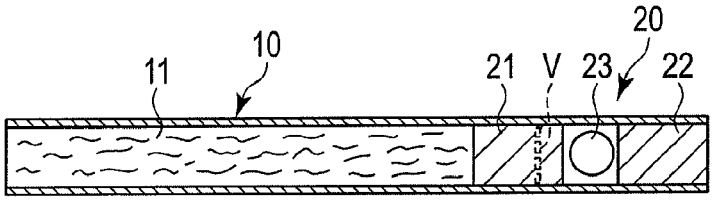
FIG. 1 is a cross-sectional view of a cigarette according to an embodiment of the present invention.

FIG. 1 is a cross-sectional view of a cigarette according to an embodiment of the present invention. The cigarette of FIG. 1 has a structure in which a filter 20 is connected to an end of a tobacco rod 10. The tobacco rod 10 is produced by wrapping a filler 11 with a cigarette paper. The filter 20 is produced by forming a first filter plug 21 at the tobacco rod side, a second filter plug 22 on the cigarette end side, and a flavor capsule 23 in the cavity between the first and second filter plugs 21 and 22. Ventilation holes V are formed in the first filter plug 21. In FIG. 1, plain filters containing cellulose acetate tow are used as the first and second filter plugs 21 and 22. The first and second filter plugs 21 and 22 may be paper filters. The total length of the filter 20 is designed to be, for example, from 20 to 40 mm, the length of the first and second filter plugs 21 and 22 is designed to be, for example, from 10 to 15 mm, and the length of the cavity is designed to be, for example, from 1 to 10 mm.

Figure 2:
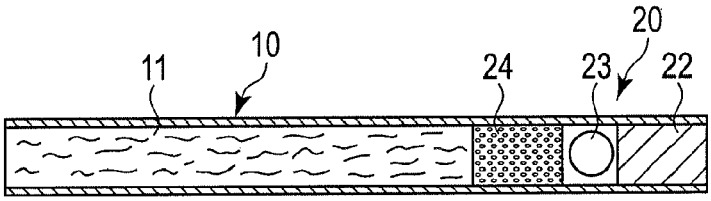
FIG. 2 is a cross-sectional view of a cigarette according to another embodiment of the present invention.

FIG. 2 is a cross-sectional view of a cigarette according to another embodiment of the present invention. The cigarette of FIG. 2 has a similar structure to that of the cigarette of FIG. 1, except that a charcoal filter 24 is used as the first filter plug. Not only the charcoal filter, but also a filter containing zeolite, silica or the like as an adsorbent may be used.

Figure 3:
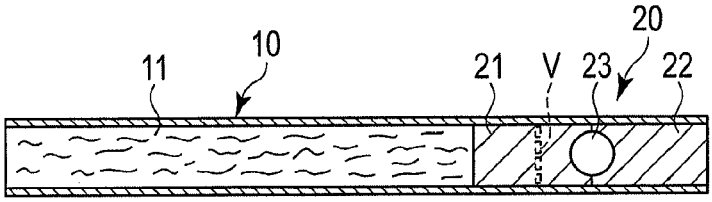
FIG. 3 is a cross-sectional view of a cigarette according to another embodiment of the present invention.

FIG. 3 is a cross-sectional view of a cigarette according to another embodiment of the present invention. The cigarette of FIG. 3 has a similar structure to that of the cigarette of FIG. 1 except that the first filter plug 21 is in contact with the second filter plug 22, and the flavor capsule 23 is arranged on the boundary thereof.

Figure 4:
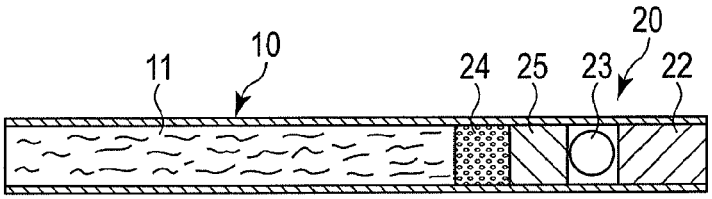
FIG. 4 is a cross-sectional view of a cigarette according to another embodiment of the present invention.

FIG. 4 is a cross-sectional view of a cigarette according to another embodiment of the present invention. The cigarette of FIG. 4 has a similar structure to that of the cigarette of FIG. 1 except that the cigarette is a four segment type, and the charcoal filter 24 and a flavor carrier 25 are used as the first filter plug. In this case, not only the charcoal filter, but also a filter containing zeolite, silica or the like as an adsorbent may be used.

Figure 5:
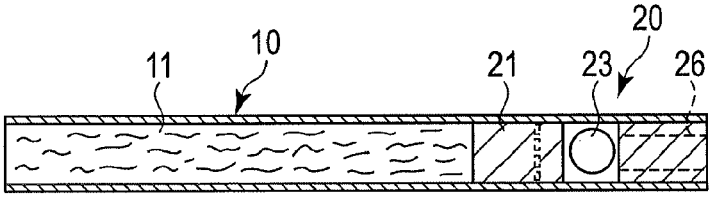
FIG. 5 is a cross-sectional view of a cigarette according to another embodiment of the present invention.

FIG. 5 is a cross-sectional view of a cigarette according to another embodiment of the present invention. The cigarette of FIG. 5 has a similar structure to that of the cigarette of FIG. 1 except that a double concentric type of filter is used as a second filter plug 26.

When the smoker smokes the cigarette of the present invention, the smoker crushes the flavor capsule 23 with fingers to allow for leakage of the flavor contained in the capsule content liquid. Ambient air is introduced from the ventilation holes formed in the first filter plug during smoking, so that the flow rate of the tobacco smoke in contact with the capsule content liquid is decreased, the contact time of the smoke with the flavor component is increased, and the amount of flavor transferred to smoke is increased. Therefore, a ratio of the flavor to the tobacco smoke component (e.g. tar) becomes relatively high. Since the ventilation resistance of the second filter plug is lower than that of the first filter plug, the flavor can be efficiently delivered by tobacco smoke.

In the present invention, it is preferable that the ventilation resistance of the second filter plug is from 10 to 40 $mmH_2O/10$ mm, and the ventilation resistance of the first filter plug is from 20 to 70 $mmH_2O/10$ mm. In the present invention, the difference in ventilation resistance between the first filter plug and the second filter plug is preferably from 10 to 37.5 $mmH_2O/10$ mm. In the present invention, the ventilation resistance of the second filter plug is preferably from 20 to 60% of the ventilation resistance of the first filter plug.

As the ventilation resistance of the filter plug, a value when the length of the filter plug is 10 mm is used. However, if the length of the filter plug varies, the ventilation resistance of the filter plug varies in proportion to the variation.

In the present invention, the filter ventilation rate (Vf) of the cigarette is preferably from 20 to 80%. More preferably, the Vf is 30% or more. As described later, it is preferable that the filter ventilation rate (Vf) of the cigarette is higher than a curve represented by: $Vf=-31.656\times\ln(Tar)+92.462$, in a graph where an amount of tar (Tar)[mg/cigarette] is on the horizontal axis and Vf is on the vertical axis.

In the present invention, the ventilation resistance of the whole cigarette is preferably from 80 to 120 $mmH_2O/120$ mm. If the ventilation resistance of the whole cigarette is less than 80 $mmH_2O/120$ mm or exceeds 120 $mmH_2O/120$ mm, the ventilation resistance is too low or too high. In either case, smoking becomes difficult.

Here, it is preferable to increase a difference between the ventilation resistance of the first filter plug and the ventilation resistance of the second filter plug as much as possible. So far as the ventilation resistance of the whole cigarette is close to 80 $mmH_2O/120$ mm, the difference in ventilation resistance between both of the plugs can be increased. So far as the ventilation resistance of the whole cigarette is close to 120 $mmH_2O/120$ mm, it is difficult to increase the difference in ventilation resistance between both of the plugs.

As the ventilation resistance of the whole cigarette, a value when the length of the whole cigarette is 120 mm is used. However, if the length of the whole cigarette varies, the ventilation resistance varies in proportion to the variation.

In the present invention, the flavor capsule is produced by encapsulating a capsule content liquid in a film and the capsule has a particle diameter of 3 to 6 mm.

The capsule content liquid of the flavor capsule contains a flavor and a solvent. As the flavor, menthol, vegetable essential oils or the like may be used. One or two or more types of flavors may be used. As the solvent, for example, medium-chain triglyceride (MCT) may be used. The capsule content liquid may further contain other additives, such as a dye, an emulsifier, and a thickener.

The film forming material of the flavor capsule contains, for example, starch and a gelling agent. As the gelling agent, for example, gellant gum is used. The film forming material may also contain a gelling auxiliary. As the gelling auxiliary, for example, calcium chloride is used. The film forming material may further contain a plasticizer. As the plasticizer, glycerin and/or sorbitol are used. The film forming material may further contain a colorant.

EXAMPLES

In the following examples, 45 mg of a 40% menthol/medium-chain triglyceride (MCT) solution corresponding to the content liquid of the flavor capsule was added to the first filter plug 21 in place of forming a flavor capsule in the cavity. Then, various experiments were performed.

Figure 6:
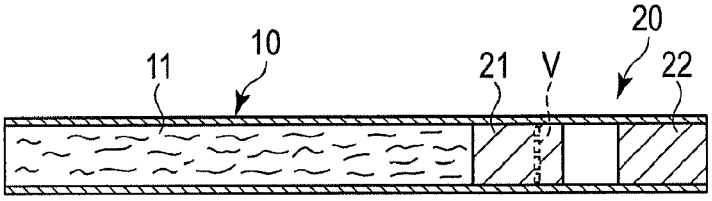
FIG. 6 is a cross-sectional view of a cigarette used in the Examples.

As shown in FIG. 6, the used cigarette has the filter 20 connected to an end of the tobacco rod 10, the filter 20 having the first filter plug 21 on the tobacco rod side and the second filter plug 22 on the cigarette end side where a cavity is formed between the first and second filter plugs 21 and 22. Ventilation holes V are formed in the first filter plug 21. A commercially available simple cigarette was used as the tobacco rod 10. The length of the first filter plug 21 was set to 10 mm, the length of the second filter plug 22 was set to 10 mm, the length of the cavity was set to 5 mm, and a distance between the cigarette end of the filter and the ventilation holes V was set to 20 mm.

The filter ventilation rate (Vf) was set to 0%, 50%, 70% or 80%. The ventilation resistance of the first filter plug was set to 20 $mmH_2O/10$ mm. The ventilation resistance of the second filter plug was set to 22, 42, 63 or 83 $mmH_2O/10$ mm.

Each of the cigarettes was smoked under ISO conditions. The tobacco smoke was collected using a Cambridge filter, followed by analysis. Then, the permeability of menthol and the ratio of menthol/tar (M/T ratio) were examined. Each data represents an average of three samples.

Figure 7:
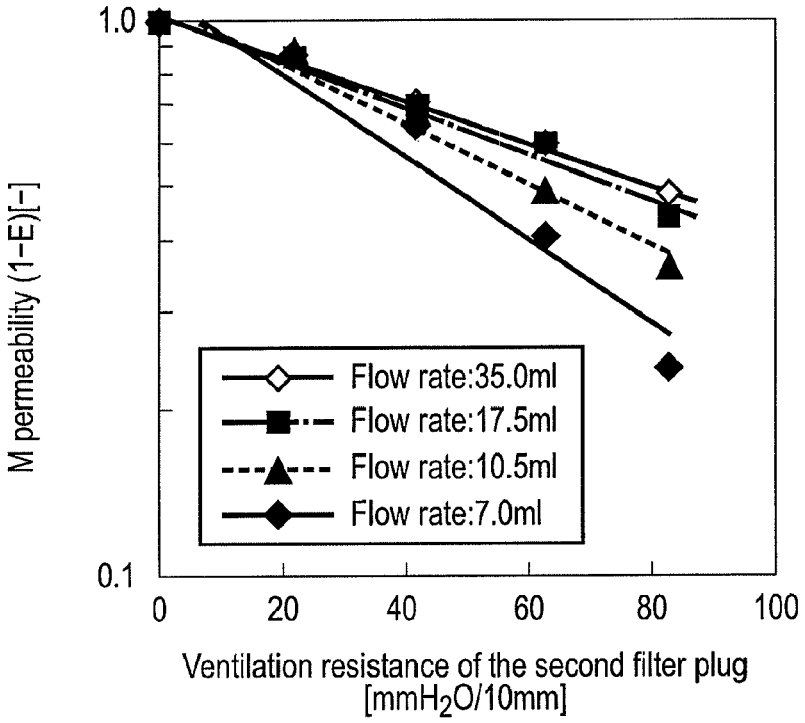
FIG. 7 is a graph showing a relationship between the ventilation resistance of the second filter plug and the menthol permeability.

FIG. 7 is a graph showing a relationship between the ventilation resistance of the second filter plug and the menthol permeability (M permeability). The relationships among the flow rates of tobacco smoke (one puff for 2 seconds) shown in FIG. 7 and the Vf are as follows.

Flow rate: 35.0 ml Vf: 0%
Flow rate: 17.5 ml Vf: 50%
Flow rate: 10.5 ml Vf: 70%
Flow rate: 7.0 ml Vf: 80%

From FIG. 7, it is found that if the ventilation resistance of the second filter plug is increased, the menthol permeability is reduced.

Figure 8:
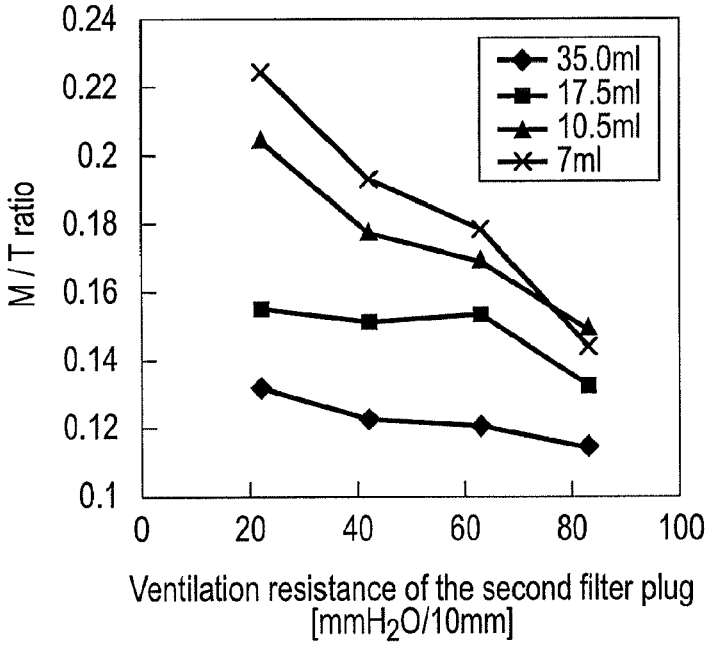
FIG. 8 is a graph showing a relationship between the ventilation resistance of the second filter plug and a ratio of menthol/tar (M/T ratio)

FIG. 8 is a graph showing a relationship between the ventilation resistance of the second filter plug and a ratio of menthol/tar (M/T ratio). From FIG. 8, it is found that so far as the ventilation resistance of the second filter plug is low, the M/T ratio tends to increase.

Figure 9:
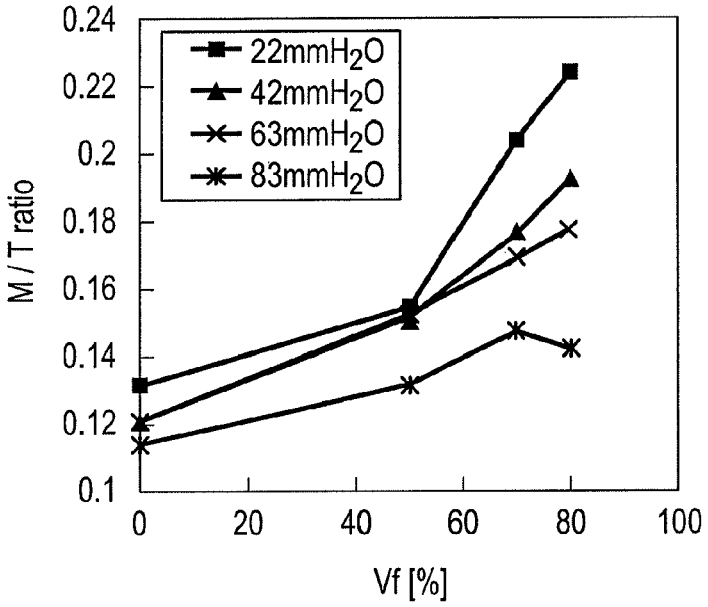
FIG. 9 is a graph showing a relationship between Vf and the ratio of menthol/tar (M/T ratio)

FIG. 9 is a graph showing a relationship between Vf and the ratio of menthol/tar (M/T ratio). From FIG. 9, it is found that if the Vf is increased, the M/T ratio tends to increase. This is because so far as the Vf increases, the flow rate of tobacco smoke in contact with menthol liquid decreases, and thus the ratio of menthol to tar in tobacco smoke becomes relatively high.

From the above experimental results, in the case of the second filter plug having a low ventilation resistance and a high Vf, a high M/T ratio is obtained.

Further, a cigarette meeting the above conditions and a cigarette not meeting the above conditions were designed, and the M/T ratios of the cigarettes were measured. The results are shown in Table 1 (Example 1 and Comparative example 1), Table 2 (Example 2 and Comparative example 2), and Table 3 (Example 3 and Comparative example 3). Table 1 shows the results of high tar cigarettes, Table 2 shows the results of medium tar cigarettes, and Table 3 shows the results of low tar cigarettes.

Figure 10:
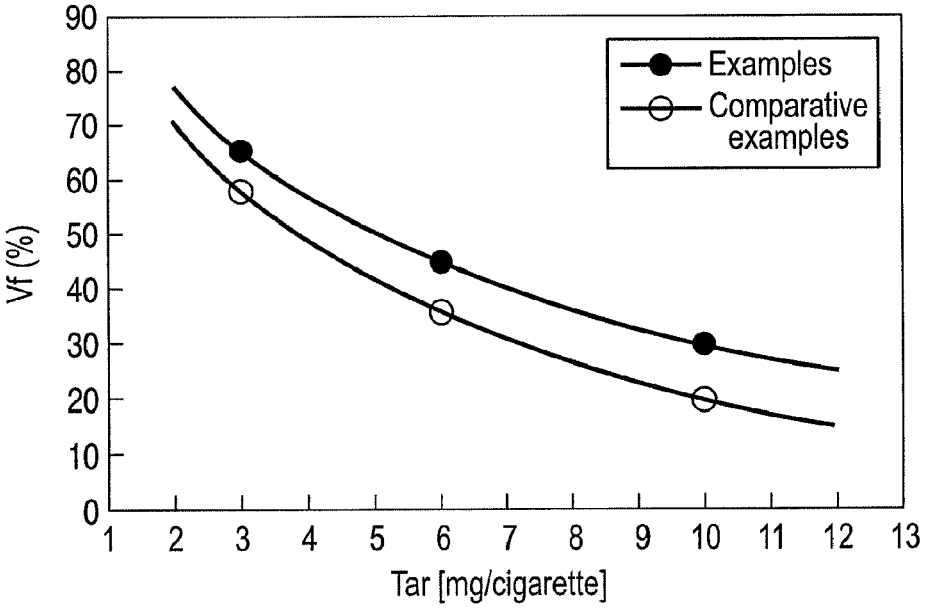
FIG. 10 is a graph showing a relationship between the amount of tar and Vf.

FIG. 10 is a graph showing a relationship between the amount of tar and the Vf. In FIG. 10, the horizontal axis shows the amount of tar (Tar) [mg/cigarette] and the vertical axis shows the Vf [%]. The curves in FIG. 10 are prepared by approximating the relationship between the amount (Tar)

and the Vf in Examples 1 to 3 and Comparative examples 1 to 3 described in Tables 1 to 3 by the relation:

$$Vf=a+b\cdot\ln(Tar).$$

The curves of the comparative examples shown in FIG. 10 are represented by the equation:

$Vf=-31.656\times\ln(Tar)+92.462$. The filter ventilation rate (Vf) of the cigarettes according to the present invention is higher than that of the comparative examples of FIG. 10.

Incidentally, the curves of the examples shown in FIG. 10 are represented by the equation:

$$Vf=-29.058\times\ln(Tar)+96.966.$$

In any of Tables 1 to 3, it is found that the M/T ratio of the examples is higher than that of the comparative examples.

From Tables 1 to 3 and FIG. 10, the Vf of the cigarette is preferably 30% or more.

It is preferable that the ventilation resistance of the first filter plug is from 20 to 70 $mmH_2O/10$ mm, the ventilation resistance of the second filter plug is from 10 to 40 $mmH_2O/10$ mm, and the difference in ventilation resistance between both of the plugs is from 10 to 37.5 $mmH_2O/10$ mm.

TABLE 1

| | Example 1 | Comparative Example 1 |
|---|---|---|
| Vf [%] | 30 | 20 |
| Ventilation resistance of the first filter [$mmH_2O/10$ mm] | 25 | 10 |
| Ventilation resistance of the second filter [$mmH_2O/10$ mm] | 10 | 39.17 |
| Difference in ventilation resistance [$mmH_2O/10$ mm] | 15 | −29.17 |
| Ventilation resistance of cigarette [$mmH_2O/120$ mm] | 80 | 106 |
| Amount of tar [mg/cigarette] | 10 | 10 |
| Amount of menthol [mg/cigarette] | 1.41 | 1.29 |
| M/T ratio | 0.141 | 0.129 |

TABLE 2

| | Example 2 | Comparative Example 2 |
|---|---|---|
| Vf[%] | 45 | 35 |
| Ventilation resistance of the first filter [$mmH_2O/10$ mm] | 45.83 | 23.33 |
| Ventilation resistance of the second filter [$mmH_2O/10$ mm] | 10 | 55.83 |
| Difference in ventilation resistance [$mmH_2O/10$ mm] | 35.83 | −32.5 |
| Ventilation resistance of cigarette [$mmH_2O/120$ mm] | 82 | 120 |
| Amount of tar [mg/cigarette] | 6 | 6 |
| Amount of menthol [mg/cigarette] | 0.97 | 0.87 |
| M/T ratio | 0.159 | 0.143 |

TABLE 3

| | Example 3 | Comparative Example 3 |
|---|---|---|
| Vf[%] | 65 | 58 |
| Ventilation resistance of the first filter [$mmH_2O/10$ mm] | 55.83 | 48.33 |
| Ventilation resistance of the second filter [$mmH_2O/10$ mm] | 23.33 | 55.83 |
| Difference in ventilation resistance [$mmH_2O/10$ mm] | 32.5 | −7.5 |
| Ventilation resistance of cigarette [$mmH_2O/120$ mm] | 80 | 115 |
| Amount of tar [mg/cigarette] | 3 | 3 |
| Amount of menthol [mg/cigarette] | 0.51 | 0.48 |
| M/T ratio | 0.167 | 0.160 |

When the experimental results are summarized, for each of the cigarette products of low tar (3 mg/cigarette), medium tar (6 mg/cigarette), and high tar (10 mg/cigarette), if the following designs are applied, the permeability of the flavor to tar during smoking can be improved.

(1) The ventilation resistance of the second filter plug is made lower than that of the first filter plug so as to increase the difference between both of the plugs as much as possible.

(2) The Vf of the cigarette is set to a value higher than the curve represented by the equation:

$$Vf=-31.656\times\ln(Tar)+92.462.$$

The invention claimed is:

1. A cigarette comprising:

a tobacco rod; and a filter comprising a first filter plug on a tobacco rod side connected to an end of the tobacco rod, a second filter plug on a cigarette end side directly adjacent the first filter plug, a flavor capsule with flavor arranged between the first filter plug and the second filter plug or in the second filter plug, and configured to be crushed to allow for leakage of the flavor when a smoker smokes the cigarette; and ventilation holes in the first filter plug configured to introduce ambient air into the first filter plug and the second filter plug during smoking, wherein ventilation resistance of the second filter plug is 20% to 60% of the ventilation resistance of the first filter plug, wherein the ventilation resistance of the second filter plug, the ventilation resistance of the first filter plug and the ventilation holes create a filter ventilation rate of the cigarette, wherein the filter ventilation rate (Vf) of the cigarette is 30% or more, wherein, in a range of tar between 3 mg and 10 mg, the filter ventilation rate (Vf) of the cigarette is higher than a filter ventilation rate curve represented by:

$$Vf=-31.656\times\ln(Tar)+92.462,$$

in a graph where an amount of tar (Tar) [mg/cigarette] is on a horizontal axis and Vf of the cigarette is on a vertical axis, and wherein the greater the filter ventilation rate (Vf) and the lower the ventilation resistance of the second filter plug, the greater a permeability of the flavor to the tar when a user smokes.

2. The cigarette according to claim 1, wherein the ventilation resistance of the second filter plug is from 10 to 40 $mmH_2O/10$ mm , and the ventilation resistance of the first filter plug is from 20 to 70 $mmH_2O/10mm$.

3. The cigarette according to claim 1, wherein a difference in ventilation resistance between the first filter plug and the second filter plug is from 10 to 37.5 $mmHH_2O/10$ mm.

4. The cigarette according to claim 1, wherein the ventilation resistance of the whole cigarette is from 80 to 120 $mmH_2O/120$ mm.

5. The cigarette according to claim 1, wherein the difference in the ventilation resistance between the first filter plug and second filter plug is configured to increase as the ventilation resistance of the whole cigarette approaches 80 $mmH_2O/120$ mm from 120 $mmH_2O/120$ mm.

6. The cigarette according to claim 1, wherein the ventilation holes extend perpendicular to a longitudinal axis of the tobacco rod.

7. The cigarette according to claim 1, wherein the filter ventilation rate (Vf) of the cigarette is depicted a filter ventilation rate curve represented by:

$$Vf=-29.058\times\ln(Tar)+96.966.$$

* * * * *